US008997651B2

(12) United States Patent
Kato et al.

(10) Patent No.: US 8,997,651 B2
(45) Date of Patent: Apr. 7, 2015

(54) PRINTING OPERATION ASSISTING DEVICE

(75) Inventors: Mitsuaki Kato, Anjyo (JP); Tomohiko Hattori, Kariya (JP)

(73) Assignee: Fuji Machine Mfg. Co., Ltd., Chiryu (JP)

( * ) Notice: Subject to any disclaimer, the term of this patent is extended or adjusted under 35 U.S.C. 154(b) by 518 days.

(21) Appl. No.: 13/359,130

(22) Filed: Jan. 26, 2012

(65) Prior Publication Data

US 2012/0201587 A1 Aug. 9, 2012

(30) Foreign Application Priority Data

Feb. 9, 2011 (JP) ..... 2011-025571

(51) Int. Cl.

| | |
|---|---|
| ***B41F 1/66*** | (2006.01) |
| ***B41F 15/36*** | (2006.01) |
| ***B41F 33/00*** | (2006.01) |
| ***B41F 35/00*** | (2006.01) |
| ***B41F 15/08*** | (2006.01) |

(52) U.S. Cl.

CPC ..... *B41F 15/36* (2013.01); *B41F 33/0036* (2013.01); *B41F 35/005* (2013.01); *B41F 15/0881* (2013.01); *B41P 2215/50* (2013.01); *B41P 2235/24* (2013.01)

(58) Field of Classification Search

USPC ..... 101/484

See application file for complete search history.

(56) References Cited

U.S. PATENT DOCUMENTS

| | | | | |
|---|---|---|---|---|
| 5,564,183 | A * | 10/1996 | Satou et al. | 29/840 |
| 6,244,174 | B1 * | 6/2001 | Sirowitzki et al. | 101/212 |
| 6,945,167 | B2 * | 9/2005 | Maeda et al. | 101/123 |
| 2002/0019680 | A1 * | 2/2002 | Nishikawa et al. | 700/121 |
| 2004/0218808 | A1 * | 11/2004 | Prince | 382/150 |
| 2004/0237813 | A1 * | 12/2004 | Maeda et al. | 101/123 |
| 2007/0265743 | A1 * | 11/2007 | Kojitani et al. | 701/29 |
| 2010/0189340 | A1 * | 7/2010 | Ueda | 382/145 |

FOREIGN PATENT DOCUMENTS

| | | |
|---|---|---|
| JP | A-10-202832 | 8/1998 |
| JP | A-2003-260781 | 9/2003 |
| JP | A-2005-067058 | 3/2005 |
| JP | A-2005-067059 | 3/2005 |

OTHER PUBLICATIONS

Oct. 28, 2014 Office Action issued in Japanese Patent Application No. 2011-025571 (with English translation).

* cited by examiner

*Primary Examiner* — Anthony Nguyen
(74) *Attorney, Agent, or Firm* — Oliff PLC

(57) ABSTRACT

A printing operation assisting device for assisting a printing operation performed by a solder printer configured to print a solder cream on a substrate surface, including: a measure determining portion configured to determine a remedial measure against a deterioration of a print quality specified on the basis of print-result information obtained from an inspecting machine configured to inspect a print result by the printer, in accordance with a kind of the print-quality deterioration; and a measure issuing portion configured to issue a command relating to the remedial measure determined by the measure determining portion to at least one of the printer and its operator, wherein the measure determining portion is configured to determine a remedial measure against a certain print-quality deterioration and to redetermine another remedial measure different from the previously determined remedial measure where the deteriorated print quality is not improved by execution of the previously determined measure.

8 Claims, 10 Drawing Sheets

PRINTING OPERATION ASSISTING DEVICE

CROSS REFERENCE TO RELATED APPLICATION

The present application claims priority from Japanese Patent Application No. 2011-025571, which was filed on Feb. 9, 2011, the disclosure of which is herein incorporated by reference in its entirety.

BACKGROUND OF THE INVENTION

1. Field of the Invention

The present invention relates to a device for assisting a printing operation performed by a solder printer to print a solder cream on a surface of a substrate.

2. Discussion of Related Art

In a manufacture of an electric circuit, there is generally conducted a printing operation in which a solder cream is screen printed on a surface of a substrate, prior to mounting of electric components on the substrate surface. Where there occurs a deterioration in a print quality (hereinafter referred to as the "print-quality deterioration" where appropriate) in such a printing operation, it is required to take measures for improving the print quality such as a change in printing conditions, an adjustment of a solder cream, cleaning of a screen. (Hereinafter, such a measure is simply referred to as the "remedial measure" where appropriate.) Currently, it is proposed to automatically determine an appropriate remedial measure on the basis of a print result, as disclosed in the following Patent Literatures:

Patent Literature 1: JP-A-2005-67059

Patent Literature 2: JP-A-10-202832

SUMMARY OF THE INVENTION

To determine an appropriate remedial measure is an important matter in assisting the printing operation, and it is possible to more effectively assist the printing operation by making some modifications as to the determination of the remedial measure. The present invention has been developed in view of such situations. It is therefore an object of the invention to provide a printing operation assisting device with high utility.

The object indicated above may be attained according to a principle of the invention, which provides a printing operation assisting device for assisting a printing operation performed by a solder printer configured to print a solder cream on a surface of a substrate, comprising:

a measure determining portion configured to determine a remedial measure against a deterioration of a print quality specified on the basis of print-result information obtained from an inspecting machine configured to inspect a print result of the printing operation performed by the solder printer, in accordance with a kind of the deterioration of the print quality; and a measure issuing portion configured to issue a command relating to the remedial measure determined by the measure determining portion to at least one of the solder printer and an operator of the solder printer, wherein the measure determining portion is configured to determine a remedial measure against a certain deterioration of the print quality and to redetermine another remedial measure different from the previously determined remedial measure where the deteriorated print quality is not improved by execution of the previously determined remedial measure.

According to the printing operation assisting device constructed as described above, an appropriate remedial measure is determined in accordance with the kind of the deterioration of the print quality, whereby it is possible to conduct an effective assistance to the printing operation by the solder printer. Further, the print quality can be improved at a stage before reaching a failure of the print quality. Moreover, since the remedial measure is determined and issued stepwise with respect to a certain kind of the print-quality deterioration, it is possible to more effectively improve or remedy the print quality.

FORMS OF INVENTION

There will be explained various forms of an invention which is considered claimable (hereinafter referred to as "claimable invention" where appropriate). Each of the forms of the invention is numbered like the appended claims and depends from the other form or forms, where appropriate. This is for easier understanding of the claimable invention, and it is to be understood that combinations of constituent elements that constitute the invention are not limited to those described in the following forms. That is, it is to be understood that the claimable invention shall be construed in the light of the following descriptions of various forms and embodiments. It is to be further understood that any form in which one or more elements is/are added to or deleted from any one of the following forms may be considered as one form of the claimable invention. Some of the forms of the claimable invention may be an invention relating to claims.

In the following forms, a combination of the forms (1) and (3) corresponds to claim 1. A form in which the limitation of the form (4) is added to claim 1 corresponds to claim 2. A form in which the limitation of the form (5) is added to claim 1 corresponds to claim 3. A form in which the limitation of the form (7) is added to claim 1 corresponds to claim 4. A form in which the limitation of the form (8) is added to claim 4 corresponds to claim 5. A form in which the limitation of the form (6) is added to claim 1 corresponds to claim 6. A form in which the limitation of the form (2) is added to claim 1 corresponds to claim 7.

(1) A printing operation assisting device for assisting a printing operation performed by a solder printer configured to print a solder cream on a surface of a substrate, comprising:

a measure determining portion configured to determine a remedial measure against a deterioration of a print quality specified on the basis of print-result information obtained from an inspecting machine configured to inspect a print result of the printing operation performed by the solder printer, in accordance with a kind of the deterioration of the print quality; and a measure issuing portion configured to issue a command relating to the remedial measure determined by the measure determining portion to at least one of the solder printer and an operator of the solder printer, This form is a basic form of a printing operation assisting device of the claimable invention. In the printing operation assisting device according to this form, an appropriate remedial measure is automatically determined in accordance with the kind of the deterioration in the print quality (hereinafter referred to as the "print-quality deterioration" where appropriate). By employing the present device, the printing operation by the solder printer can be effectively assisted. In this respect, the present device ensures high utility.

The "print-quality deterioration" in this form includes phenomena such as "area increase", "area decrease", "protrusion formation", "thickness decrease", "thickness increase", "print shift". In the present specification, the print-quality deterioration in a substrate which is not preferable to such an extent that an electric circuit should not be manufactured using the substrate is referred to as a "print-quality failure" and the "print-quality failure" is distinguished from the "print-quality deterioration". The "print-quality failure" may be caused by worsening of the "print-quality deterioration". In this sense, the "print-quality deterioration" may be considered as a sign or precursor of the "print-quality failure". Accordingly, by employing the printing operation assisting device in this form, the print quality can be improved at a stage before reaching the print-quality failure. In other words, a certain kind of the print failure can be obviated.

The "remedial measure" is a measure for improving the quality to be executed with respect to the print-quality deterioration and includes cleaning of a lower surface of a screen that will be later explained, for instance. In other words, the remedial measure is a measure for lowering a degree of the print-quality deterioration or eliminating the print-quality deterioration. On the other hand, a measure of simply "suspending the printing operation" is not treated as "the remedial measure" in the present specification. In this respect, a superordinate conceptional measure including such a measure and the "remedial measure" is referred to as a "coping measure". It is noted the above-described "measure determining portion" may be configured to not only merely determine the remedial measure, but also widely determine the coping measure as a whole.

The "command relating to the remedial measure" issued by the "measure issuing portion" may be a signal including information for permitting the solder printer to execute the remedial measure, for instance, where the command is issued to the solder printer. Further, where the command is issued to the operator, the command may be an indication, an alarm, or the like to the effect that "the remedial measure should be executed", for instance. The "measure issuing portion" may be configured to include: a measure transmit portion to transmit the command to the solder printer; and a measure informing portion to inform the operator of the command through a suitable informing device such as a display, and the "measure issuing portion" may be configured such that at least one of the measure transmit portion and the measure informing portion is operable with respect to the command relating to one remedial measure.

(2) The printing operation assisting device according to the above form (1), wherein the solder printer is configured to execute, as the printing operation, an operation in which the solder cream on an upper surface of a screen is printed on the surface of the substrate by a squeegee through the screen with a lower surface of the screen pressed onto the substrate, and wherein the measure determining portion is configured to determine, as the remedial measure, any of cleaning of the lower surface of the screen, an adjustment of the solder cream, and a change of conditions of the printing operation.

In this form, the remedial measures that can be determined by the measure determining portion are concretely listed. The "adjustment of the solder" is a concept that includes "solder supply" which is an adjustment of an amount of the solder, "solder kneading" which is an adjustment of a viscosity of the solder, etc. The "change of conditions of the printing operation" is a concept that includes "change of a printing speed (squeegee moving speed)", "change of a number of times of printing" which includes execution of the reciprocating printing, etc., "change of a separating speed at which the substrate is moved or separated away from the screen upon completion of printing", "change of a temperature in the solder printer", etc. It is noted that the "change of a temperature in the solder printer" may be regarded as one arrangement of the "adjustment of the solder" because the temperature in the solder printer influences the viscosity of the solder.

(3) The printing operation assisting device according to the above form (1) or (2), wherein the measure determining portion is configured to determine a remedial measure against a certain deterioration of the print quality and to redetermine another remedial measure different from the previously determined remedial measure where the deteriorated print quality is not improved by execution of the previously determined remedial measure.

In the printing operation assisting device according to this form, the remedial measure is determined and issued stepwise with respect to a certain kind of the print-quality deterioration. For the certain kind of the print-quality deterioration, some causes exist and some remedial measures in accordance with the respective causes are conceived. In the present printing operation assisting device, the remedial measures are sequentially determined and issued one by one or in groups of two or more, so that the print quality can be effectively improved.

(4) The printing operation assisting device according to the above form (1), wherein the solder printer is configured to execute, as the remedial measure, a plurality of mutually different cleaning operations for cleaning a lower surface of a screen, and wherein the measure determining portion is configured to determine a certain cleaning operation as one remedial measure and to redetermine, as the remedial measure, another cleaning operation different from the previously determined certain cleaning operation where the deteriorated print quality is not improved by execution of the previously determined certain cleaning operation.

The "cleaning operations for cleaning a lower surface of a screen" includes various kinds of cleaning such as "dry cleaning", "wet cleaning", "dry vacuum cleaning", "wet vacuum cleaning" as will be later explained. Each of the "dry vacuum cleaning" and the "wet vacuum cleaning" is a combination of the "dry cleaning" or "wet cleaning" with a suction action. For instance, while the wet cleaning generally ensures a higher degree of cleaning capability than the dry cleaning, the wet cleaning needs a use of a solvent and there may be concern about an influence of the solvent on a solder flux component. While the vacuum cleaning is suitable for removing the solder remaining in openings of the screen, there may be a risk of an adverse influence of suction. Thus, the cleaning operations in different kinds have different characteristics. By employing the present printing operation assisting device, the cleaning operations having different characteristics are sequentially determined and issued stepwise, enabling the print quality to be effectively improved.

(5) The printing operation assisting device according to any one of the forms (1)-(4), wherein the measure determining portion is configured to determine a measure relating to suspension of the printing operation where the print quality is not improved by execution of the remedial measure, and wherein the measure issuing portion is configured to issue the measure relating to suspension of the printing operation.

The printing operation assisting device according to this form may be configured to issue a command to the effect that subsequent printing operations to be performed on substrates to follow by the solder printer should be suspended for the reason that the print quality is to be drastically or fundamentally improved, for instance. Such a command as to the "printing suspension" may be issued to the solder printer for enabling the solder printer to automatically suspend or stop the printing operation. Alternatively, the command as to the "printing suspension" may be issued only to the operator, namely, the operator may be informed of the command, for the purpose of calling an operator's attention to a notice that the printing operation should be suspended.

(6) The printing operation assisting device according to any one of the forms (1)-(5), further comprising, a print-quality deterioration specifying portion configured to judge an occurrence of the deterioration of the print quality on the basis of the print-result information obtained from the inspecting machine and to specify the kind of the deterioration of the print quality.

The printing operation assisting device according to this form has a function of specifying an occurrence of the print-quality deterioration and the kind of the occurred print-quality deterioration, so that the device has enhanced utility. In this regard, the "print-quality deterioration specifying portion" may be configured to specify the above-described print-quality failure. That is, the present device may have a print-quality deterioration/failure specifying portion that is integrated with a print-quality failure specifying portion. In a system wherein the inspecting machine has such a function (though the system is not included in this form), the present printing operation assisting device does not necessarily require the above-described "print-quality deterioration specifying portion". In this instance, the measure determining portion may be configured to determine the remedial measure on the basis of information sent from the inspecting machine, namely, information as to the kind of the specified print-quality deterioration.

(7) The printing operation assisting device according to any one of the forms (1)-(6), wherein the measure determining portion is configured to determine the remedial measure on the basis of a linking between the kind of the deterioration of the print quality and the remedial measure, and wherein the printing operation assisting device further comprises a measure linking setting portion configured to set the linking on the basis of an intention of an operator of the printing operation assisting device.

As will be explained later, the kind of the print-quality deterioration is diverse, and the remedial measure appropriate for each kind depends on specifications, capability, etc., of the printer. Further, the cause of the print-quality deterioration is diverse depending upon the kind of the substrate used in the printing operation, the shape, the number, the layout pattern, of solder pads (referred also to as "solder lands"), and so on. In view of such situations, a determination as to which remedial measure is appropriate for which kind of the print-quality deterioration differs from user to user. According to the printing operation assisting device in this form, the remedial measures appropriate for various kinds of the print-quality deterioration are determined so as to meet the user's demand or request, so that the present printing operation assisting device has a considerably high utility.

(8) The printing operation assisting device according to the form (7), further comprising a display, wherein the measure linking setting portion is configured to indicate, on the display, (a) an icon list area in which are listed icons relating to various kinds of the deterioration of the print quality and icons relating to a plurality of executable remedial measures and (b) an icon placement area in which arbitrary ones of the listed icons can be placed by a manipulation of the operator of the printing operation assisting device, and wherein the measure linking setting portion is configured to interrelate a certain kind of the deterioration of the print quality indicated by one icon placed in the icon placement area and the remedial measure indicated by at least one icon placed at a position in the icon placement area that corresponds to a position of the one icon, as the remedial measure against the certain kind of the deterioration of the print quality.

This form relates to the printing operation assisting device in which setting processing by the "measure linking setting portion" is concretely limited. According to the printing operation assisting device in this form, the above-described linking can be carried out in a considerably simplified manner.

(9) A solder printing operation system, comprising:

the solder printer described above;

the inspecting machine described above; and the printing operation assisting device defined in any one of the forms (1)-(8) and configured to enable communication between the solder printer and the inspecting machine.

In this form, the category of the invention is changed from the printing operation assisting device to the system of the solder printing operation. The advantages of this form are substantially the same as those explained above with respect to the printing operation assisting device, and an explanation thereof is omitted.

BRIEF DESCRIPTION OF THE DRAWINGS

The above and other objects, features, advantages and technical and industrial significance of the present invention will be better understood by reading the following detailed description of embodiments of the invention, when considered in connection with the accompanying drawings, in which.

DETAILED DESCRIPTION OF THE EMBODIMENTS

There will be hereinafter explained in detail a printing operation assisting device according to an embodiment of the claimable invention with reference to the drawings, as one embodiment of the claimable invention. It is to be understood that the claimable invention may be embodied with various changes and modifications based on knowledge of those skilled in the art, in addition to the following embodiments and various forms described in the FORMS OF INVENTION.

EMBODIMENTS

<Overall Structure of Electric-Circuit Manufacture System>

Figure 1:
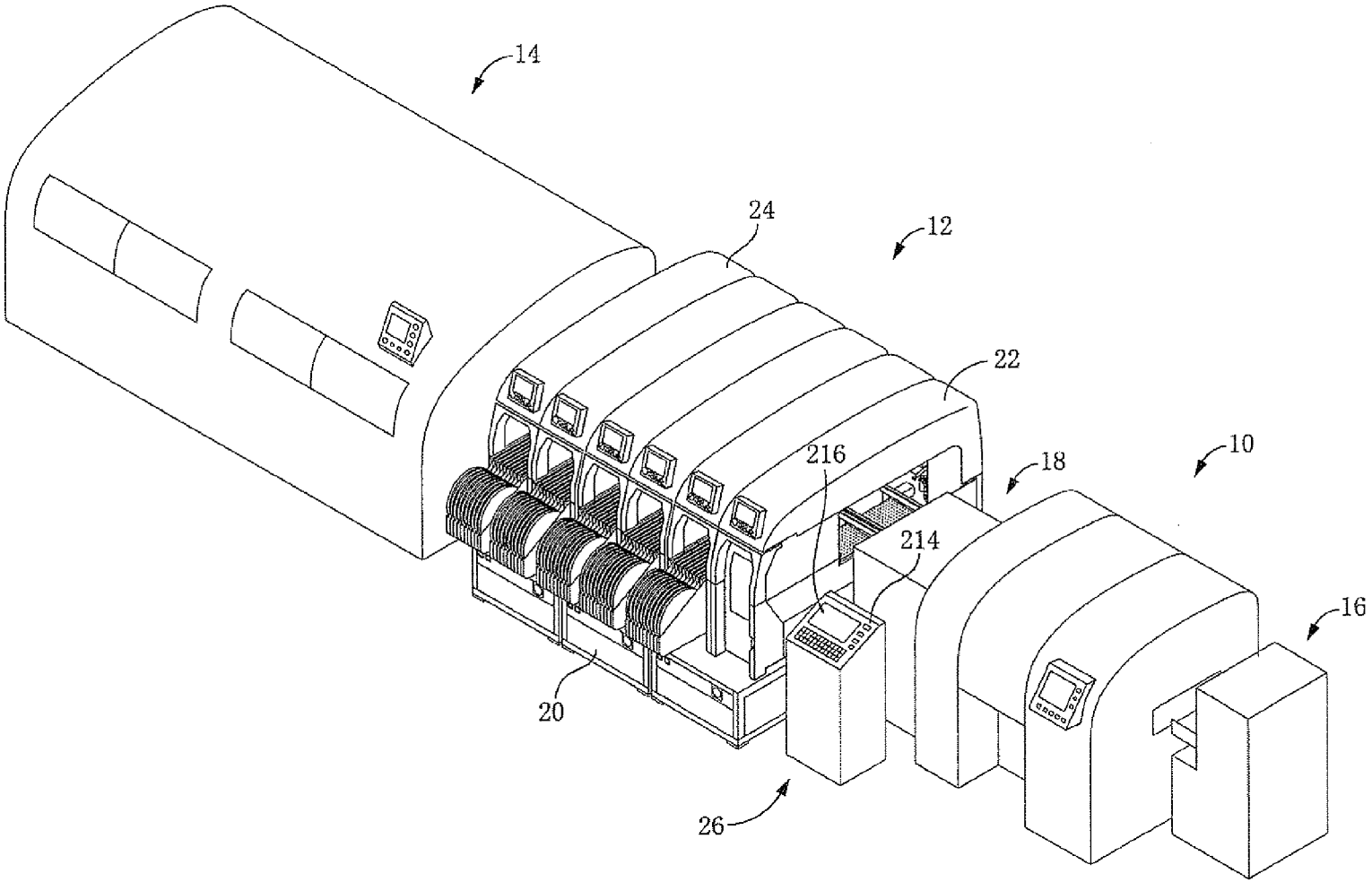
FIG. 1 is a perspective view showing an electric-circuit manufacture system including a printing operation assisting device according to one embodiment of the claimable invention.

FIG. 1 illustrates an electric-circuit manufacture system including a solder printer as a target for assistance by a printing operation assisting device according to the present embodiment. This system includes, as main constituent elements, a solder printer (hereinafter simply referred to as the "printer" where appropriate) 10, a component mounting machine 12, and a reflow furnace 14. The printer 10, the component mounting machine 12, and the reflow furnace 14 are arranged in this order from an upstream side (a right side in FIG. 1) to a downstream side (a left side in FIG. 1), and constitute one line.

The printer 10 screen-prints a solder cream on a surface of a circuit substrate (hereinafter simply referred to as the "substrate" where appropriate). In other words, the printer 10 prints a solder pattern defined by a screen. The component mounting machine 12 mounts various electric components, electronic components and the like (hereinafter simply referred to as the "component" or "components" where appropriate) which constitute the electric circuit, on the surface of the substrate on which the solder has been printed. The reflow furnace 14 heats the component-mounted substrate so as to melt and solidify the solder and thereby fixes the components onto the substrate. The substrate is fed one by one from a substrate feeder 16 located at the most upstream position and is conveyed by conveyers of the respective printer 10, component mounting machine 12, and reflow furnace 14, whereby operations by the respective printer 10, component mounting machine 12, and reflow furnace 14 are sequentially performed. As a result, the manufacture of the electric circuit on the substrate is completed. The substrates are successively fed in and the manufacture of the electric circuits is successively implemented. In the printer 10, the conveyance and the printing operation are performed in one line while, in the component mounting machine 12 and the reflow furnace 14, the conveyance and the respective operations are performed in two lines. Accordingly, there is disposed, between the printer 10 and the component mounting machine 12, a substrate distributor 18 configured to distribute the solder-printed substrates into the two lines.

The component mounting machine 12 is constituted by one base 20 and six modules disposed on the base 20. As will be explained later in detail, the most upstream one of the six modules is a print-result inspecting device 22 (hereinafter simply referred to as the "inspecting device 22" where appropriate) functioning as an inspecting machine configured to inspect a print result of the solder, and the remaining five modules are component mounting devices 24 configured to perform a mounting operation independently of each other.

The present system is equipped with the printing operation assisting device described above, namely, a printing operation assisting device 26 (hereinafter simply referred to as the "assisting device 26" where appropriate) for assisting a printing operation by the printer 10. As will be explained later in detail, this assisting device 26 is configured to determine a measure (hereinafter referred to as the "coping measure" where appropriate) to cope with a deterioration of a print quality, a print failure (i.e., print-quality failure), etc., on the basis of print-result information obtained by the inspection of the inspecting device 22, to command the printer 10 to execute the determined coping measure, and to inform an operator of the printer 10 in addition to or in place of the command. The present system may be regarded as a system including a solder printing operation system equipped with the printer 10, the inspecting device 22, and the assisting device 26.

<Structure of Solder Printer>

Figure 2:
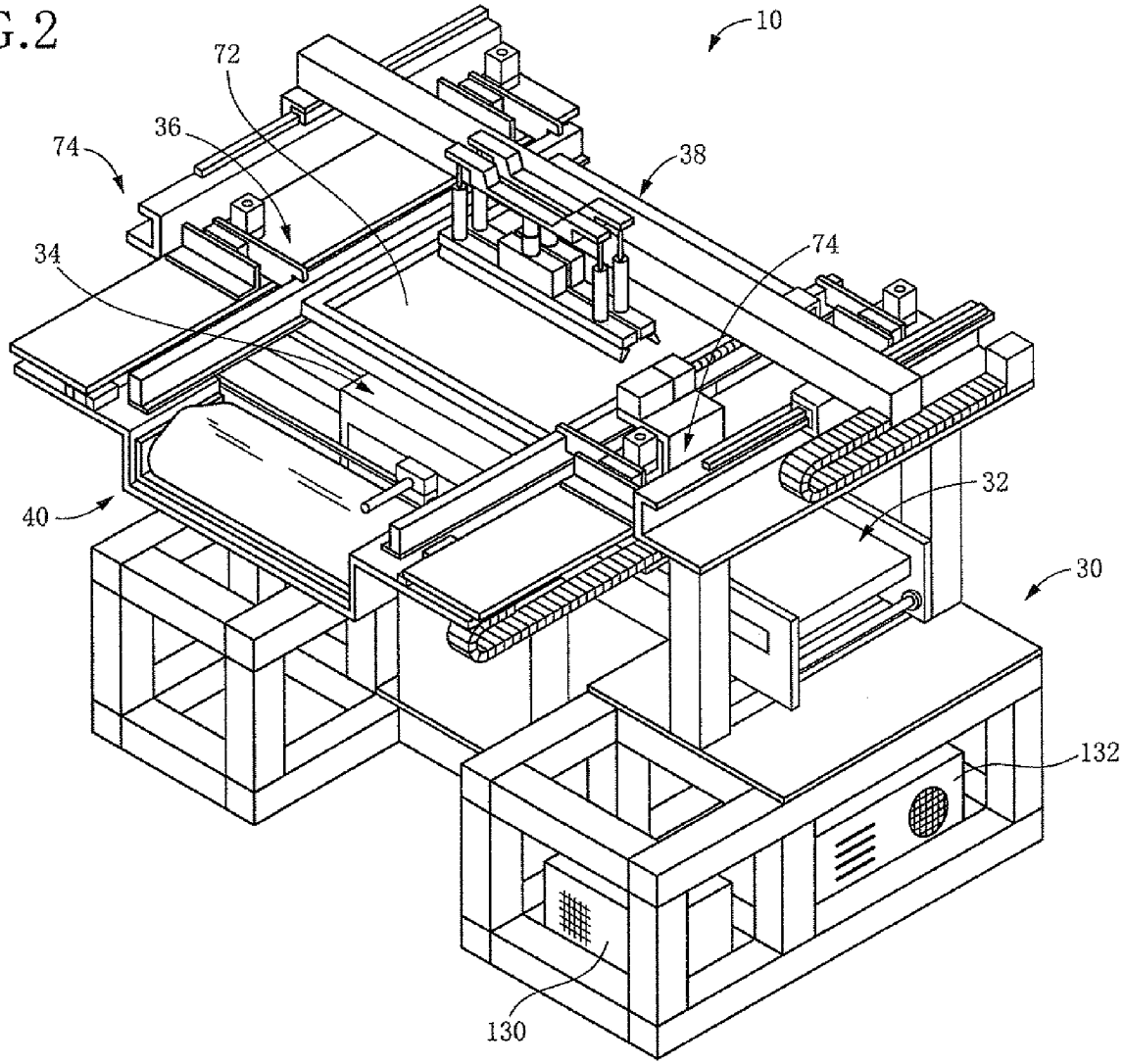
FIG. 2 is a perspective view showing a solder printer in a state in which an exterior panel is detached.

FIG. 2 shows the printer 10 in a state in which an exterior panel is detached therefrom. The printer 10 includes a base frame 30 constituted principally by pipes. The printer 10 is constituted by a substrate conveyor device 32, a substrate holding and moving device 34, a screen holding device 36, a squeegee device 38, a cleaning device 40, a mark image taking device 42 (not illustrated in FIG. 2), etc., disposed on and held by the base frame 30.

Figure 3:
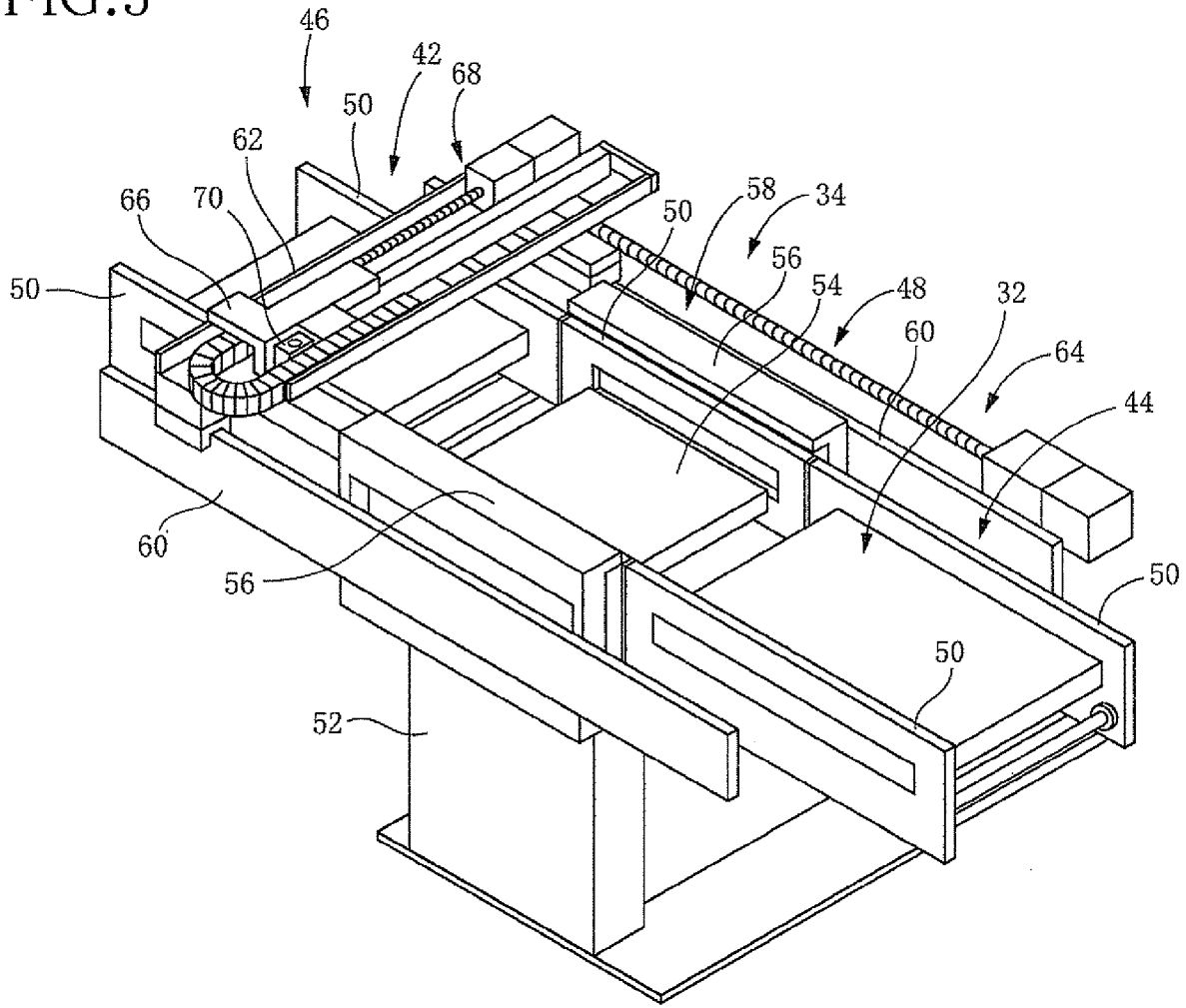
FIG. 3 is a perspective view showing a substrate conveyor device, a substrate holding and moving device, and a mark image taking device which constitute the solder printer.

FIG. 3 shows the substrate conveyor device 32 (hereinafter simply referred to as the "conveyor device 32" where appropriate), the substrate holding and moving device 34, and the mark image taking device 42. The conveyor device 32 is divided into a feed-in portion 44 located on an upstream side in a direction in which the substrate is conveyed (hereinafter referred to as the "substrate conveyance direction" or the "left-right direction" where appropriate), a feed-out portion 46 located on a downstream side in the substrate conveyance direction, and an intermediate portion 48 interposed between the feed-in portion 44 and the feed-out portion 46. Each of the feed-in portion 44, the feed-out portion 46, and the intermediate portion 48 includes a pair of side plates 50 supported by the base frame 30. Conveyor belts (illustration of which is omitted in FIG. 3) are supported on mutually opposed inside surfaces of the side plates in each pair, such that the conveyor belts are rotated. The substrate is conveyed such that opposite ends thereof are placed on the respective conveyor belts. The distance between the pair of side plates 50 is changeable depending upon the width of the substrate.

The substrate holding and moving device 34 includes a base 52 and a backup plate 54 supported by the base 52 and located between the pair of side plates 50 of the intermediate portion 48 of the conveyor device 32. The backup plate 54 is movable upward and downward by a backup plate elevating and lowering mechanism disposed on the base 52 and is configured to lift up the substrate that has been conveyed to a prescribed position of the intermediate portion 48 by the conveyor device 32, by being moved upward by the backup plate elevating and lowering mechanism. The substrate holding and moving device 34 includes a clamp 58 having a pair of holding members 56 and supported by the base 52. The clamp 58 is configured to hold the opposite ends of the substrate lifted up by the backup plate 52. The clamp 58 is configured to be moved upward and downward together with the backup plate 54 by a clamp elevating and lowering mechanism disposed on the base 52, with the substrate held by the clamp 58.

The mark image taking device 42 is disposed above the conveyor device 32 and the substrate holding and moving device 34 and below the screen holding device 36, so as to be interposed therebetween. The mark image taking device 42 has: a pair of guide rails 60 extending in the substrate conveyance direction; a movable beam 62 which extends in a direction that is horizontal and is perpendicular to the substrate conveyance direction (hereinafter referred to as the "front-rear direction" where appropriate) and which is movable in the substrate conveyance direction by being guided by the pair of guide rails 60; a beam moving mechanism 64 for moving the movable beam 62; a slide 66 which is movable in the front-rear direction by being guided by the movable beam 62; a slide moving mechanism 68 for moving the slide 66 in the front-rear direction; and a camera 70 held by the slide 66. The camera 70 is configured to take images of both of an upper side and a lower side and is configured to be moved in the left-right direction and the front-rear direction so as to take images of: position fiducial marks attached to arbitrary positions on the surface, namely, the upper surface, of the substrate held by the substrate holding and moving device 34; and position fiducial marks attached to arbitrary positions on a lower surface of a screen 72 (FIG. 2) which may be referred to as a "mask" and which is held by the screen holding device 36.

Figure 4:
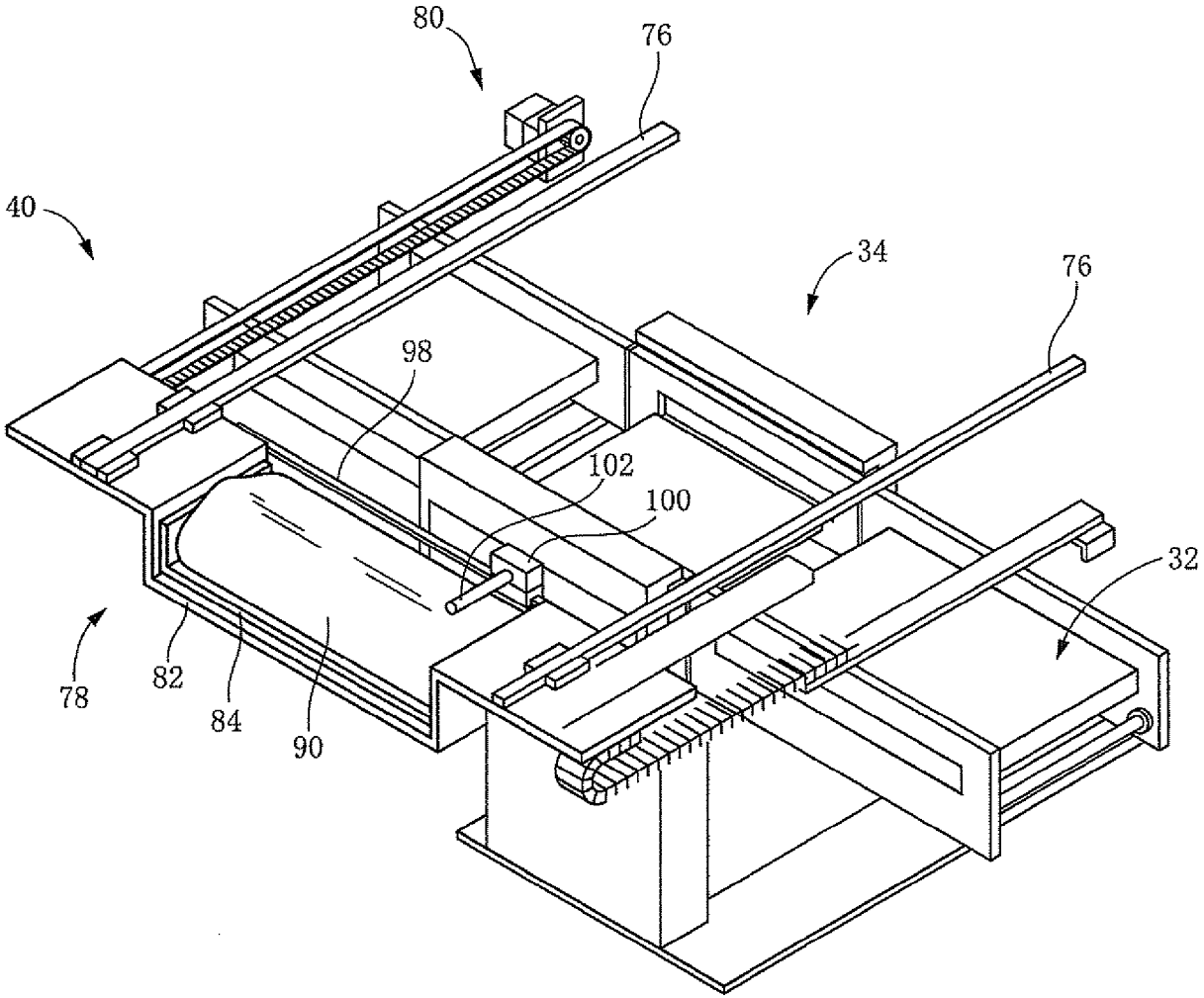
FIG. 4 is a perspective view showing the substrate conveyor device, the substrate holding and moving device, and a cleaning device which constitute the solder printer.

FIG. 4 shows the conveyor device 32, the substrate holding and moving device 34, and the cleaning device 40. The cleaning device 40 is disposed above the mark image taking device 42 and below the screen holding device 36 so as to be interposed therebetween. The cleaning device 40 is configured to clean the lower surface of the screen 72. The cleaning device 40 includes: a pair of guide rails 76 respectively fixed to lower surfaces of a pair of support beams 74 (which will be explained); a cleaning unit 78 which is movable in the front-rear direction by being guided by the pair of guide rails 76; and a cleaning-unit moving mechanism 80 for moving the cleaning unit 78 in the front-rear direction. As shown in FIG. 2, each support beam 74 is formed by bonding a channel-like member and a plate-like member, and the pair of support beams 74 which partially constitute the base frame 30 extend in the front-rear direction.

Figure 5:
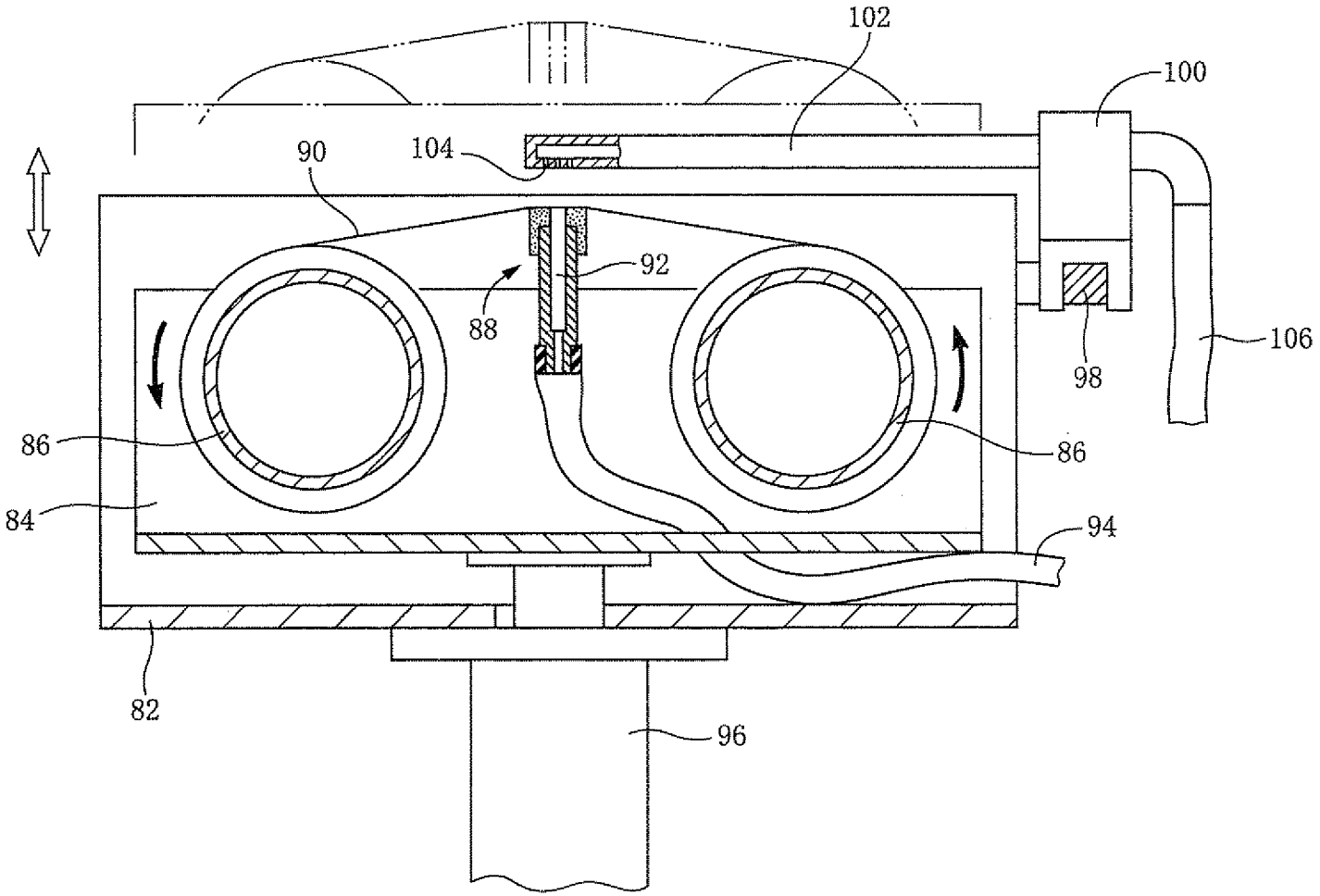
FIG. 5 is a cross-sectional view showing a cleaning unit which constitutes the cleaning device.

Referring also to FIG. 5, the cleaning unit 78 includes a support base 82 having a flanged channel-like shape; a channel-like elevating and lowering base 84 supported by the support base 82 so as to be movable upward and downward; a pair of rollers 86 held by the elevating and lowering base 82; and a backing member 88 fixed to the elevating and lowering base 82 between the two rollers 86. A nonwoven fabric 90 is wound around each roller 86. More specifically, the nonwoven fabric 90 on one of the two rollers 86 is configured to be unwound and subsequently wound up on the other of the two rollers 68. The backing member 88 has a length that extends over the entire width of the nonwoven fabric 90. An upper end portion of the backing member 88 is located at a height position higher than portions of the nonwoven fabric 90 wound around the rollers 86, whereby the backing member 88 lifts up the nonwoven fabric 90 at the upper end portion thereof. The upper end portion of the backing member 88, namely, a portion thereof that contacts the back surface of the nonwoven fabric 90, is formed of a felt. The backing member 88 is formed with a slit 92 that extends over the substantially entire width of the nonwoven fabric 90. The slit 92 is connected to a negative pressure source (not shown) via a vacuum tube 94.

The cleaning unit 78 includes an elevating and lowering mechanism constituted principally by a cylinder 96, as a mechanism for elevating and lowering the pair of rollers 86, the backing member 88, and the nonwoven fabric 90, together with the elevating and lowering base 84. In FIG. 5, a state in which the pair of rollers 86, etc., are located at the lowest position is indicated by the solid line while a state in which the pair of rollers 86, etc., are located at the elevated position is indicated by the long dashed double-short dashed line. Further, the cleaning unit 78 includes: a guide rail 98 disposed so as to extend on the back side of the support base 82; a slide 100 which is movable in the left-right direction along the guide rail 98; a nozzle 102 supported by the slide 100 so as to extend frontward; and a nozzle moving mechanism (not shown) for moving the nozzle 102 by moving the slide 100. A distal end of the nozzle 102 is located above the portion of the nonwoven fabric 90 at which the backing member 88 contacts the back surface of the nonwoven fabric 90. There is formed, at the distal end of the nozzle 102, a small nozzle hole 104 opening downward. The nozzle 102 is in communication with a solvent supplier (not shown) via a supply tube 106. An organic solvent such as alcohol is supplied from the solvent supplier, and the organic solvent is dripped to the above-indicated portion of the nonwoven fabric 90 at which the backing member 88 contacts the back surface of the nonwoven fabric 90. When the pair of rollers 86, the nonwoven fabric 90, etc., are moved upward and downward by the elevating and lowering mechanism, the nozzle 102 is moved to a right-side end or a left-side end within its moving range, so as not to interfere the upward and downward movement of the pair of rollers 86, the nonwoven fabric 90, etc. FIG. 4 shows a state in which the cleaning unit 78 is located at a standby position on the front side of the printer 10. The standby position is provided also on the back side of the printer 10.

Figure 6:
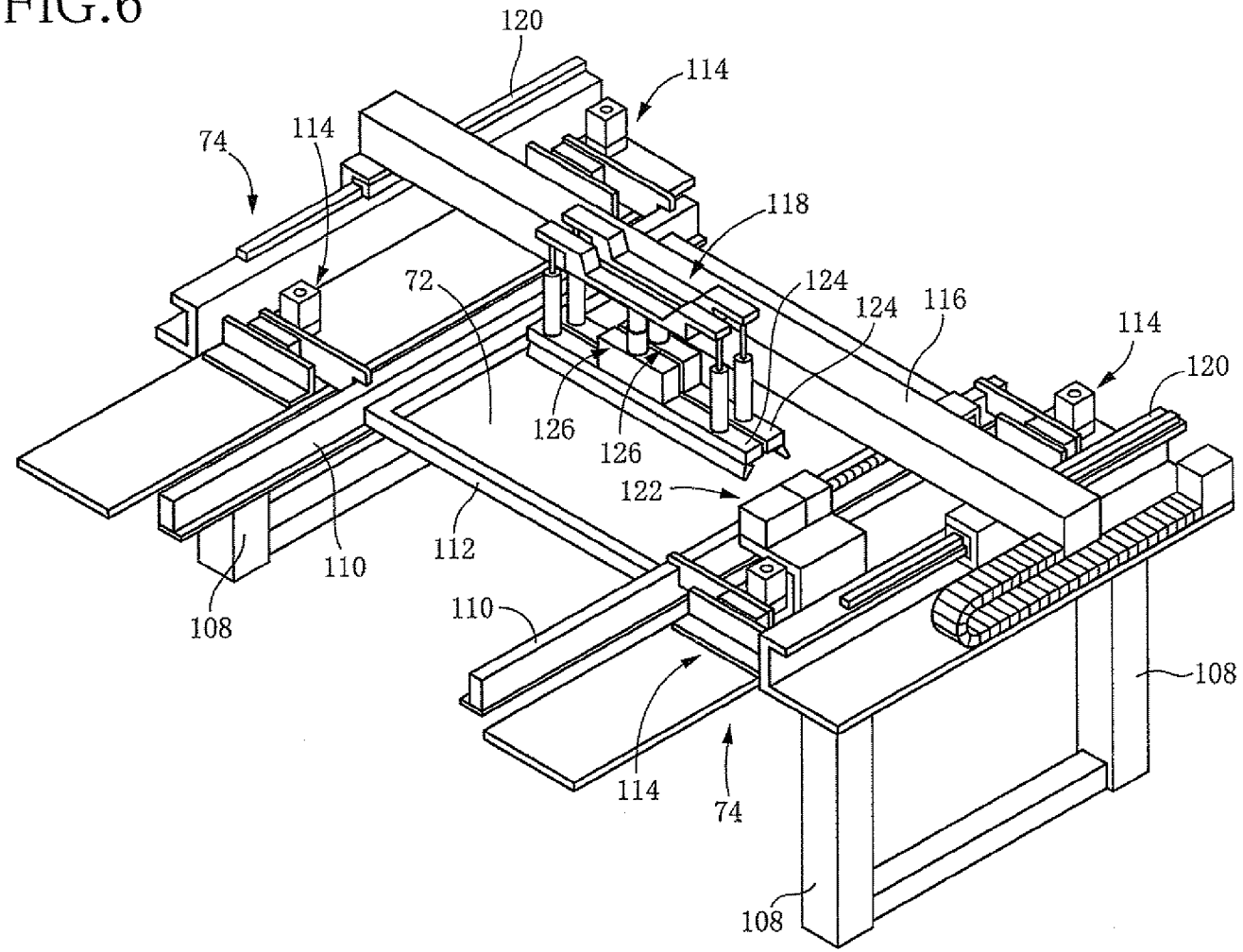
FIG. 6 is a perspective view showing a screen holding device and a squeegee device which constitute the solder printer.

FIG. 6 shows the screen holding device 36 and the squeegee device 38. The screen holding device 36 and the squeegee device 38 are supported by the above-indicated pair of support beams 74 disposed on columns 108 that partially constitute the base frame 30. The screen holding device 36 includes a pair of holding beams 110 respectively supported by the support beams 74. The screen 72 is fixed to a screen frame 112, and the pair of holding beams 110 hold the screen frame 112. When the screen 112 is replaced with another one, the screen 112 is replaced together with the screen frame 112. The screen holding device 36 includes a pair of position adjust mechanisms 114 provided for each of the holding beams 110 for displacing, in the front-rear and the left-right directions, positions of two portions of each holding beam 110. The two pairs of position adjust mechanisms 114 enable position adjustment (which is a concept including rotational position adjustment, namely, posture adjustment) of the screen 72.

The squeegee device 38 includes a movable beam 116 and a squeegee unit 118 held by the movable beam 116. The movable beam 116 is supported at its opposite ends by a pair of guide rails 120 provided on the respective support beams 74, so as to extend in the left-right direction. The movable beam 116 is movable in the front-rear direction. The movable beam 116 is configured to be moved by a movable-beam moving mechanism 122. The squeegee unit 118 includes a pair of squeegees 124 arranged in the front-rear direction and a pair of squeegee elevating and lowering mechanisms 126 for moving the respective squeegees 124 upward and downward.

In the screen 72, a multiplicity of small openings are formed so as to correspond to a multiplicity of portions of the substrate on each of which the solder is printed. In a state in which the substrate is in contact with the lower surface of the screen 72, the solder cream supplied on the upper surface of the screen 72 is squeegeed by the squeegee 124 that is moved with the upper surface of the screen 72 held in contact with squeegee 124, whereby the openings formed in the screen 72 are filled with the solder. The solder filling the openings pass through the openings and is printed on the substrate surface as if mimeographing is carried out. That is, the solder is printed on the substrate surface through the screen 72. When the pair of squeegees 124 are moved by the movable-beam moving mechanism 122 in one motion of the pair of squeegees 124 by the squeegee device 38 in one direction (hereinafter referred to as the "printing motion" where appropriate), only one of the squeegees 124 which is located on the back side in the moving direction is brought into contact with the upper surface of the screen 72 while the other of the squeegees 124 which is located on the front side in the moving direction is kept away from the upper surface of the screen 72, by a corresponding one of the squeegee elevating and lowering mechanisms 126. That is, the printing motion is carried out such that the printing direction is reversed for every printing motion, namely, the printing direction is switched between the forward direction and the backward direction of the printer 10 for every printing motion. Where the printing motion is carried out by moving the pair of squeegees 124 backward, namely, by moving the pair of squeegees 124 from the front side to the back side, only the squeegee 124 located on the front side is lowered while the other squeegee 124 located on the back side is raised. On the other hand, where the printing motion is carried out by moving the pair of squeegees 124 frontward, namely, by moving the pair of squeegees 124 from the back side to the front side, only the squeegee 124 located on the back side is lowered while the other squeegee 124 located on the front side is raised. The solder cream supplied on the upper surface of the screen 72 is moved thereon so as to roll in a roll-like shape between the pair of squeegees 124 when printed. Hereinafter, solder cream in such a state may be referred to as the "solder roll" where appropriate.

The operations of the conveyor device 32, the substrate holding and moving device 34, the screen holding device 36, the squeegee device 38, the cleaning device 40, the mark image taking device 42, etc., indicated above are controlled by a controller 130 (FIG. 2) disposed at a lower portion of the base frame 30. The viscosity of the solder cream in the printing operation influences the print quality. Accordingly, the printer 10 is equipped, at the lower portion of the base frame 30, with an air conditioner 132 (FIG. 2) for adjusting a temperature of an inner space enclosed with the exterior panel.

In a solder printing operation by the thus constructed printer 10, the feed-in portion 44 of the conveyor device 32 receives the substrate on which the printing operation is to be performed and which is supplied from the substrate feeder 16. The substrate is conveyed to a prescribed position of the intermediate portion 48, namely, to a printing position, by a cooperative action of the feed-in portion 44 and the intermediate portion 48. Thereafter, the backup plate 54 of the substrate holding and moving device 34 is moved upward, whereby the substrate is lifted up from the conveyer to a position at which the substrate is held by the clamp 58, namely, to a clamp position. At the position, the substrate is held by the clamp 58. In this state, the camera 70 of the mark image taking device 42 reads: a substrate ID mark and substrate-position fiducial marks attached to the surface (the upper surface) of the substrate; and screen-position fiducial marks attached to the lower surface of the screen 72. The information read by the camera 70 is processed by the controller 130, so that the ID of the substrate is identified and a position shift amount between the substrate and the screen 72 is obtained. On the basis of the obtained position shift amount, the position adjustment of the screen 72 is performed by the position adjust mechanisms 114 of the screen holding device 36, so as to correspond to the position of the substrate.

After the position adjustment described above, with the substrate held by the clamp 58, the substrate is lifted up, together with the backup plate 54, to a position at which the substrate comes into contact with the lower surface of the screen 72. In a state in which the substrate is lifted up to the position, the printing of the solder is performed by the squeegee device 38. More specifically, the printing is performed such that the squeegee unit 118 is moved one time from the front side to the back side or from the back side to the front side, with one of the squeegees 124 kept in contact with the upper surface of the screen 72. The substrate which has been subjected to this motion, namely, the substrate on which the printing has been performed, is lowered to the clamp position, together with the backup plate 54. After the substrate has been released from the clamp 58 at that position, the backup plate 54 is further lowered, whereby the substrate is placed on the conveyor. Thereafter, the substrate is conveyed to the feed-out portion 46 by a cooperative action of the intermediate portion 48 and the feed-out portion 46 of the conveyor device 32, and is subsequently fed out to the substrate distributor 18 by the feed-out portion 48. The obtained information as to the ID is transmitted to the component mounting machine 10 and the printing operation assisting device 26, together with print completion information.

The cleaning operation on the lower surface of the screen 72 by the cleaning device 40 is carried out in an instance where the quality of the solder printing which has been performed on the substrate is deteriorated, for instance. In the present system, the cleaning operation is carried out automatically on the basis of a command from the printing operation assisting device 26 (as will be later explained in detail) or carried out manually at an arbitrary time on the basis of an operation of an operator of the printer 10. The cleaning operation is carried out such that the screen 72 is wiped with the nonwoven fabric 90 during a movement of the cleaning unit 78 from one of the front-side standby position and the back-side standby position toward the other of the front-side standby position and the back-side standby position. More specifically, the cleaning unit 78 is initially moved from one of the front-side and the back-side standby positions to below one end portion of the screen 72. Subsequently, the elevating and lowering base 84 is elevated, whereby the nonwoven fabric 90 is elevated to a height position at which the nonwoven fabric 90 comes into contact with the lower surface of the screen 72. At that height position, the cleaning unit 78 is moved to below the other end portion of the screen 72 and, at this position, the nonwoven fabric 90 is lowered back to the original height position. Thereafter, the cleaning unit 78 is moved to the other of the two standby positions, so that a cleaning motion is completed. Every time one cleaning motion is completed, the pair of rollers 86 are rotated by a prescribed angle such that a clean and unused section of the nonwoven fabric 90 is brought into contact with the backing member 88.

The cleaning motion includes "dry cleaning" in which the cleaning operation is conducted without moistening the nonwoven fabric 90 with the solvent and "wet cleaning" in which the cleaning operation is conducted with the nonwoven fabric 90 moistened with the solvent. Where "wet cleaning" is carried out, the solvent is dripped from the nozzle 102 onto the portion of the nonwoven fabric 90 with which the backing member 88 is in contact, before the cleaning motion described above is carried out. The cleaning operation further includes "vacuum cleaning" in which suction is performed. In "vacuum cleaning", the negative pressure source and the backing member 88 are kept in communication with each other for a time period during which the nonwoven fabric 90 is held in contact with the lower surface of the screen 72, thereby performing suction through the slit 92. That is, in the present printer 10, it is possible to selectively perform four kinds of cleaning operations, i.e., "dry cleaning", "wet cleaning", "dry vacuum cleaning", and "wet vacuum cleaning".

<Structure of Component Mounting Machine, Etc.>

Figure 7:
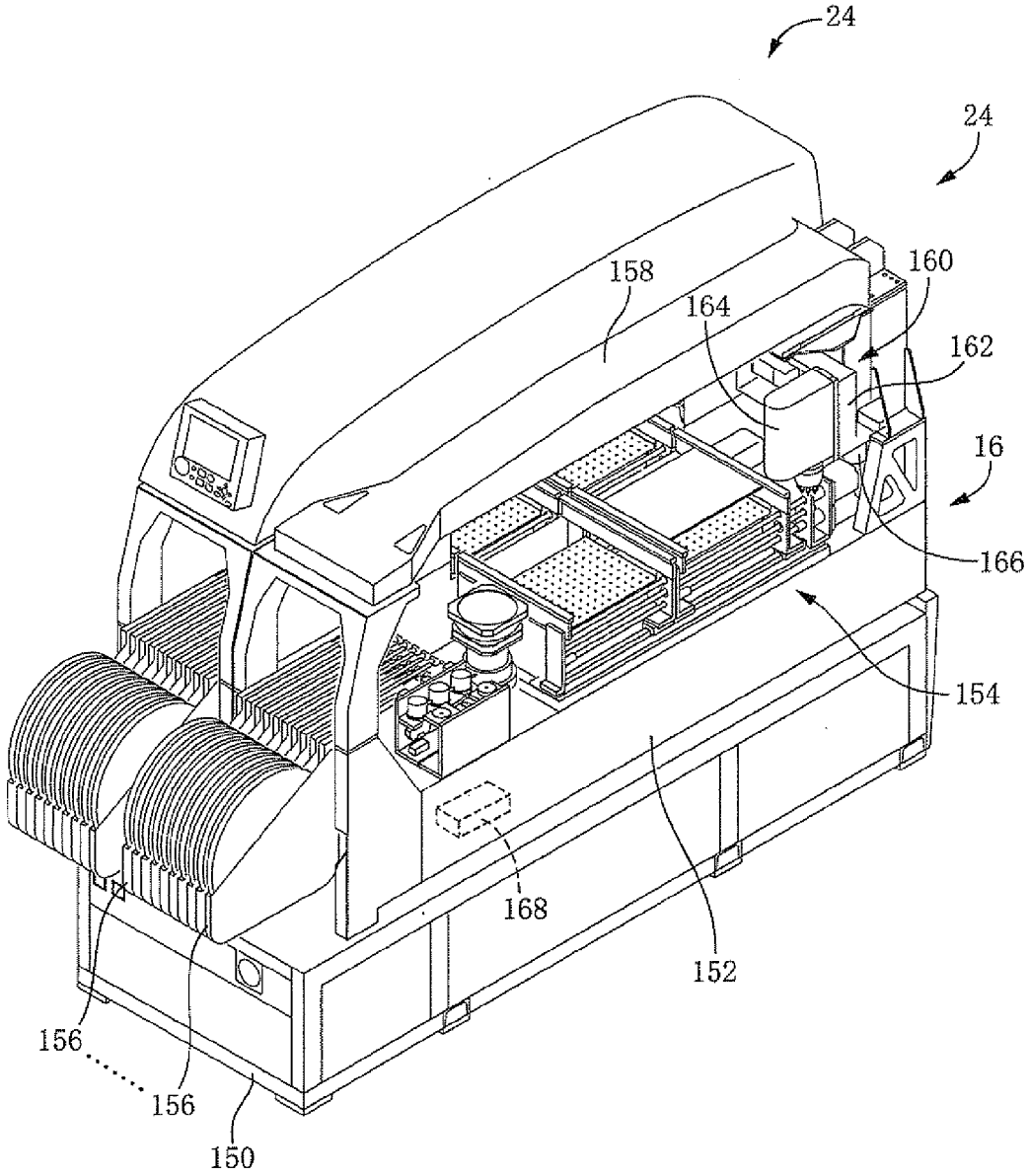
FIG. 7 is a perspective view showing a component mounting device which constitutes a component mounting machine.

FIG. 7 shows a portion of the component mounting machine 12, more specifically, one base unit 150 constituting a part of the base 20, and two component mounting devices 24 disposed on the base unit 150. The component mounting device 24 includes: a frame 152 as a support base; a substrate conveying and fixing device 154 supported by the frame 152; a plurality of feeder-type component suppliers 156 (each of which is hereinafter simply referred to as the "component supplier 156" where appropriate) disposed on the frame 152; a beam 158 disposed above the frame 152; an X-Y type moving device 160 supported by the beam 154; a head holding device 162 configured to be moved by the X-Y type moving device 160; a mounting head 164 fixedly held by the head holding device 162; a camera 166 fixed to a lower portion of the head holding device 162 and capable of taking images of the substrate surface; and a controller 168 configured to control the component mounting devices 24. The substrate conveying and fixing device 154 is constituted such that two conveyor devices are arranged so as to enable an operation by the component mounting machine 12 to be implemented in two lines. The structure of the component mounting devices 24 is general, and its detailed explanation is dispensed with.

In a mounting operation by each component mounting device 24, the substrate is fed in from an upstream-side device by the substrate conveying and fixing device 154, and the substrate is fixed at a prescribed position. The mounting head 164 is configured to be movable by the X-Y type moving device 160 in a work area of the component mounting device 24. The mounting head 164 is configured to hold, by its component holding device, a component supplied form the component supplier 156 and to mount the component on the substrate fixed by the substrate conveying and fixing device 154. The holding and the mounting of the component are repeatedly implemented, so that a component mounting operation by one component mounting device 24 on one substrate is completed. As shown in FIG. 1, the component mounting machine 12 is constituted by five component mounting devices 24 that are arranged in the substrate conveyance direction. The component mounting operation by each of the five component mounting devices 24 is implemented on substrate that is being conveyed, whereby the mounting operation by the component mounting machine 12 on one substrate is completed. In the present component mounting device 24, prior to the component mounting, the camera 166 takes images of the substrate-position fiducial marks and the substrate ID mark attached to the surface of the substrate fixed by the substrate conveying and fixing device 154. On the basis of the substrate position information obtained by taking images of the substrate-position fiducial marks, the controller 168 controls the component mounting device 24 such that the components are accurately mounted on positions on the substrate at which the components should be mounted.

Figure 8:
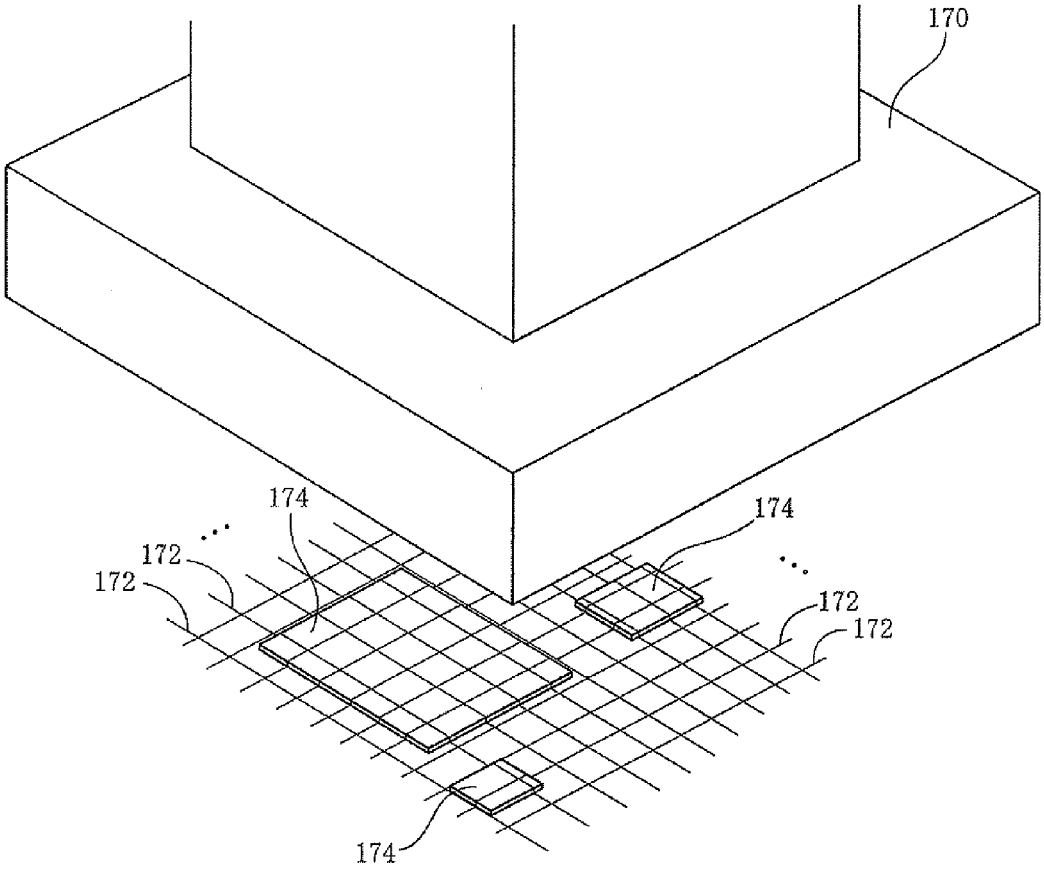
FIG. 8 is a perspective view showing a state wherein a substrate on which a solder has been printed by the solder printer is inspected by a print-result inspecting device which is a part of the component mounting machine.

As explained above, in the component mounting machine 12, the print-result inspecting device 22 is disposed at the most upstream portion on the base 20, namely, on the upstream side of the five component mounting devices 24. The print-result inspecting device 22 is similar in construction to the component mounting device 24. In general, the print-result inspecting device 22 differs from the component mounting device 24 in that the print-result inspecting device 22 does not have the component supplier 156 and has a print inspecting head 170 in place of the mounting head 164. While not explained in detail, as shown in FIG. 8, the print inspecting head 170 includes: a light source for applying a slit light obliquely from four different directions so as to form a grid on the surface of the substrate; and a camera for taking an image of the light grid formed on the surface of the substrate obliquely from two directions. In one line 172 constituting the grid formed by the applied slit light, a part of the line 172 formed on one solder pad 174 (also referred to as the "solder land"), namely, formed on a portion on the substrate on which the solder is printed, is shifted from a part of the line 172 formed on the surface of the substrate on which no solder pads 174 are formed. An amount of the shift varies depending upon the thickness (the height) of the one solder pad 174. By permitting the print inspecting head 170 to scan the entire surface of the substrate, the controller 168 obtains three-dimensional information of each of all solder pads 174 printed on the substrate surface, utilizing the principle described above. The controller 168 is configured to transmit, to the printing operation assisting device 26, the obtained information as it is or quality-related information based on the obtained information (e.g., information as to what kind of the print-quality deterioration occurs at which portion of the substrate or what kind of the print-quality deterioration occurs in the substrate as a whole).

Structures and functions of each of other machines and devices such as the reflow furnace 14, the substrate feeder 16, and the substrate distributor 18 are generally known, and an explanation thereof is dispensed with. The structure and the function of the printing operation assisting device 26 will be later explained in detail.

<Deterioration of Print Quality, Causes and Effective Remedial Measures, and Print Failure>

There will be next explained a deterioration of the print quality (also referred to as the "print-quality deterioration") of the substrate which has been subjected to the solder printing by the printer 10, causes of the print-quality deterioration, and coping measures, more specifically, remedial measures for improving the print quality. There will be further explained a print failure (i.e., print-quality failure) caused as a result of worsening of the print-quality deterioration. For the sake of convenience, the "print-quality deterioration" means a print quality ensuring that the circuit substrate to be manufactured is acceptable as a product. The "print failure" means that the electric circuit to be manufactured is not acceptable as a product. In other words, the "print failure" means that it is preferable not to manufacture the electric circuit using the substrate.

(A) Print-Quality Deterioration

"Print-quality deterioration" is classified into some types, namely, some kinds. There will be explained representative kinds of the print-quality deterioration, phenomenon details and effective remedial measures) for each kind.

(1) Area Increase

"Area increase" is a phenomenon in which the area of the solder pad 174 becomes larger than expected and may be referred also to as "area excess". As the remedial measure, the cleaning of the screen 72, lowering of the temperature in the printer 10 (hereinafter referred to as the "in-machine temperature" where appropriate), etc., are effective.

(2) Area Decrease

"Area decrease" is a phenomenon in which the area of the solder pad 174 becomes smaller than expected and may be referred also to as "area insufficiency". "Blur" is a typical example of the area decrease and is likely to occur in a solder pad 174 with a comparatively large area. As the remedial measure, supplying of the solder, the vacuum cleaning of the screen 72, a reduction in the printing speed, etc., are effective.

(3) Protrusion Formation

"Protrusion formation" is a phenomenon in which a protrusion is formed on the upper surface of the solder pad 174 and generally includes phenomena called "dog ear" and "tombstone". As the remedial measure, lowering of the temperature in the printer 10, etc., is effective. Further, the cleaning and an increase of a separation speed at which the substrate is separated or moved away from the screen 72 after the printing are also effective.

(4) Thickness Decrease

"Thickness decrease" is a phenomenon in which the height of the solder pad 174 is low, namely, the thickness of the solder pad 174 is small and may be referred also to as "volume decrease". As the remedial measure, the vacuum cleaning, raising of the temperature in the printer 10, reciprocating printing, etc., are effective.

(5) Thickness Increase

"Thickness increase" is a phenomenon in which the height of the solder pad 174 is high, namely, the thickness of the solder pad 174 is large and may be referred also to as "volume increase". As the remedial measure, reciprocating printing, raising of the temperature in the printer 10, kneading of the solder on the screen 72, etc., are effective.

(6) Print Shift

"Print shift" is caused by shifting of the position of the substrate held by the clamp 58 and the position of the screen 72 relative to each other. In general, a serious print shift does not occur because of execution of the position adjustment of the screen 72 described above. Due to some reasons, however, the relative position of the substrate and the screen 72 tends to shift in any direction. Against such a print shift, the following remedial measure is effective, for instance. That is, a correction amount is calculated according to a suitable statistical method on the basis of print results of some substrates, and the position adjustment of the screen 72 described above is implemented by taking account of the correction amount.

(B) Print Failure

"Print failure", i.e., "print-quality failure", may be regarded as the print-quality deterioration which is not preferable to such an extent that the electric circuit should not be manufactured. Where the print failure occurs, it is preferable to execute a coping measure for inhibiting the component mounting on the substrate suffering from the print failure. It is further preferable to execute a drastic or fundamental coping measure to prevent reoccurrence of the print failure. For the sake of convenience, in the present system, the phenomena described below are regarded as the "print failure". In this respect, the following phenomena may be regarded as the "print-quality deterioration" and the remedial measures described above may be executed thereagainst.

(1) Solder Bridge

"Solder bridge" is a phenomenon in which the solder pads 174 are connected by the solder. "Solder bridge" may cause a short circuit between terminals of the component. "Solder bridge" is caused by promotion of the above-described "area increase" such as spreading. Further, "solder bridge" is caused such that the protrusion in "protrusion formation" is enlarged and the enlarged protrusion falls and comes into contact with its adjacent solder pad 174.

(2) Solder Lack

"Solder lack" is a failure that may be referred to as the so-called no solder and is a phenomenon in which a substantial part of the solder pad 174 is not formed. "Solder lack" may cause poor electric contact of the electric circuit, insufficiency of the mounting strength of the component, etc. "Solder lack" is caused by worsening of the print-quality deterioration such as "area decrease", "protrusion formation", "thickness decrease" described above.

(3) Excessive Thickness

"Excessive thickness" is caused by worsening of "thickness increase" described above.

As mentioned above, the "print failure" tends to occur when the "print-quality deterioration" is worsened. In this sense, the "print-quality deterioration" may be considered as a sign or precursor of the "print-quality failure". Therefore, it is preferable to execute the remedial measure for improving the quality at a stage where the "print-quality deterioration" occurs, so as not to cause the "print-quality failure".

<Functions of Printing Operation Assisting Device>

The present system is equipped with the assisting device 26 described above. The assisting device 26 is configured to determine a coping measure against the print-quality deterioration, the print failure, etc., on the basis of the print-result information obtained from the inspection by the inspecting device 22 and to command the printer 10 to execute the determined coping measure or to inform the operator of the printer 10 of the determined coping measure.

Figure 9:
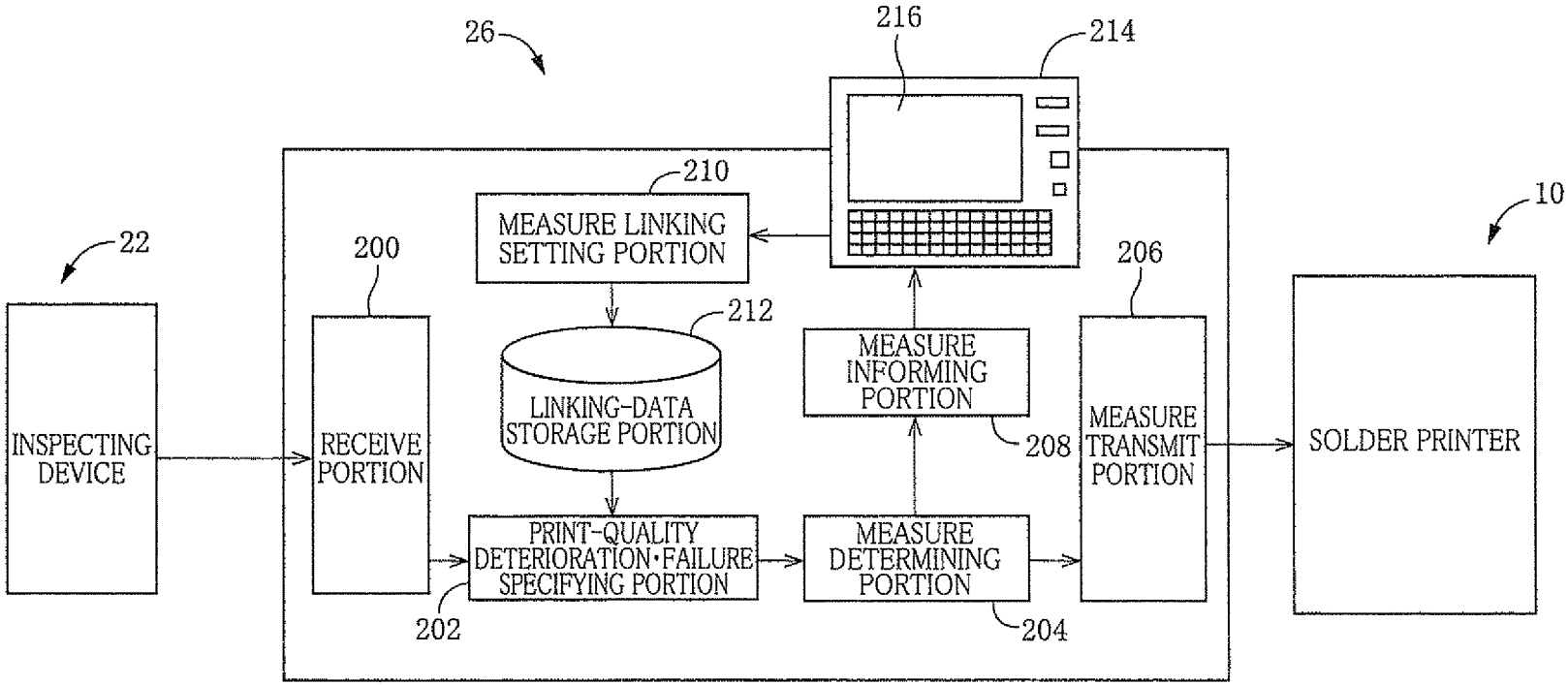
FIG. 9 is a block diagram showing a functional structure of the printing operation assisting device.

The assisting device 26 is constituted mainly by a computer and operates by execution of a prescribed program. The assisting device 26 may be regarded to have functional portions shown in FIG. 9, namely, some functional portions operable by execution of the program. More specifically, the assisting device 26 includes: a receive portion 200 configured to receive the print-result information from the inspecting device 22; a print-quality deterioration/failure specifying portion 202 configured to specify the kinds of the print-quality deterioration and the print-quality failure on the basis of the print-result information received by the receive portion 200; a measure determining portion 204 configured to determine the coping measure against the print-quality deterioration and the print-quality failure on the basis of the specified kinds of the print-quality deterioration and the print-quality failure; a measure transmit portion 206 configured to transmit, to the printer 10, a command for permitting the printer 10 to execute the coping measure determined by the measure determining portion 204; and a measure informing portion 208 configured to inform the operator of the coping measure determined by the measure determining portion 204. In this respect, it may be considered that the measure transmit portion 206 and the measure informing portion 208 integrally constitute a measure issuing portion configured to issue the command as to the coping measure determined by the measure determining portion 204 to at least one of the printer 10 and the operator.

In the present system, the three dimensional image information of the solder pads 174 of the entire substrate is transmitted to the assisting device 26 as the print-result information from the inspecting device 22. While not explained in detail, the assisting device 26 stores the three dimensional image information of appropriate solder pads 174 that should be printed on the substrate. The print-quality deterioration/failure specifying portion 202 judges whether the print-quality deterioration or the print-quality failure is occurring or not by comparing the stored three dimensional image information with the three dimensional image information sent from the inspecting device 22. More specifically, where the formation state of any of the solder pads 174 shows a tendency toward the print-quality deterioration below a certain limit, the print-quality deterioration/failure specifying portion 202 judges the quality as the "print-quality deterioration". Where the quality is further deteriorated below another limit which indicates a further worsened state than a state indicated by the above-indicated certain limit, the print-quality deterioration/ failure specifying portion 202 judges the quality as the "print-quality failure". In this respect, those limits are arbitrarily settable by the user. Further, in addition to making a judgment whether the print-quality deterioration or the print-quality failure is occurring, the print-quality deterioration/failure specifying portion 202 is configured to specify the kind of the print-quality deterioration or the print-quality failure if occurring.

It is preferable to determine the coping measure such that the coping measure is selected from among various coping measures depending upon the structure, the application, and the like, of the present system. In view of this, the measure determining portion 204 is configured to determine the coping measure that the user regards appropriate. More specifically, the assisting device 26 determines the coping measure in accordance with a linking, set by the user, between the kind of the print-quality deterioration or the print-quality failure and the coping measure. For such a determination of the coping measure, the assisting device 26 sets the linking on the basis of an intention of the operator of the assisting device 26. In other words, the assisting device 26 includes a measure linking setting portion 210 configured to form the linking according to the operation of the operator and a linking-data storage portion 212 configured to store linking data set by the measure linking setting portion 210. The measure determining portion 204 is configured to determine the coping measure on the basis of the linking data stored in the linking-data storage portion 212.

In the present system, the three dimensional image information for each solder pad 174 is received from the inspecting device 22, and the print-quality deterioration/failure specifying portion 202 of the assisting device 26 judges and specifies the print-quality deterioration or the print-quality failure. The system may be constructed as follows. The inspecting device 22 may be configured to judge and specify the print-quality deterioration or the print-quality failure on the basis of the three dimensional image information and to transmit the specified details, namely, information as to the kind of the print-quality deterioration or the print-quality failure, to the assisting device 26. The assisting device 26 may be configured to determine the coping measure on the basis of the information.

<Examples 1 of Coping Measure to be Determined>

The following TABLE 1 shows examples of the coping measure determined by the measure determining portion 204 according to the linking set by the user.

TABLE 1

| Kind of Print-Quality Deterioration/Failure | Coping Measure 1 | 2 | 3 | 4 |
|---|---|---|---|---|
| Area Increase | D Cleaning | D Cleaning & W Cleaning | In-machine Temperature −1° C. | Printing Suspension |
| Area Decrease | Solder Supply | Printing Suspension | | |
| Protrusion Formation | In-machine Temperature −1° C. | D Cleaning & W Cleaning | V Cleaning | Printing Suspension |
| Thickness Decrease | V Cleaning | Reciprocating Printing | In-machine Temperature +1° C. | Printing Suspension |
| Thickness Increase | Reciprocating Printing | Solder Kneading | Printing Suspension | |
| Print Shift | Offset Processing | Printing Suspension | | |
| Solder Bridge | Printing Suspension | | | |
| Solder Lack | Printing Suspension | | | |
| Excessive Thickness | Printing Suspension | | | |

D Cleaning: dry cleaning
W Cleaning: wet cleaning
V Cleaning: dry vacuum cleaning More specifically, where the phenomenon of "area increase" as one kind of the print-quality deterioration occurs, "dry cleaning" is first determined as a measure for improving the print quality. Where the print quality is not improved by the measure of "dry cleaning", the measure of "successively executing dry cleaning and wet cleaning" is determined. Where the print quality is not improved by the measure of "successively executing dry cleaning and wet cleaning", the measure of "lowering the temperature in the printer 10 (the in-machine temperature) by 1° C.". Where the print quality is not still improved by the measure", the measure of "printing suspension" is determined for substrates subsequent to the substrate that is currently subjected to the printing. To deal with "area decrease", "solder supply" for supplying the solder onto the screen 72 is determined as the remedial measure. Where the print quality is not improved by the measure of "solder supply", the above-indicated measure of "printing suspension" is determined. To deal with "protrusion formation", the measure of "lowering the temperature in the printer 10 by 1° C." is determined. Where the print quality is not improved by the measure of "lowering the temperature in the printer 10 by 1° C.", the measure of "successively executing dry cleaning and wet cleaning" is determined. Thereafter, the measure of "dry vacuum cleaning" and the measure of "printing suspension" are determined in order. To deal with "thickness decrease", the measure of "dry vacuum cleaning" is initially determined. Thereafter, the measure of "reciprocating printing" in which the printing is implemented twice by reversing the moving direction of the squeegees 124, the measure of "raising the temperature in the printer 10 by 1° C., and the measure of "printing suspension" are sequentially determined. To deal with "thickness increase", the measure of "reciprocating printing", the measure of "solder kneading" in which the solder on the screen 72 is kneaded, and the measure of "printing suspension" are determined in order. To deal with "print shift", "offset processing" is initially determined as the remedial measure. In "offset processing", the shift amount of the substrate in question and the shift amounts of some substrates are obtained according to the statistical technique and the position adjustment of the screen 72 considering the obtained shift amounts is implemented in the printing operation on subsequent substrates. Where the quality is not still improved by the measure, the measure of "printing suspension" is determined. To deal with "solder bridge", "solder lack", or "excessive thickness", each of which is the print-quality failure, occurs, "printing suspension" is determined as the coping measure, without determining the remedial measure.

In the present assisting device 26, a plurality of remedial measures can be stepwise determined against certain kinds of the print-quality deterioration, namely, against "area increase", "protrusion formation", "thickness decrease", and "thickness increase" as described above. Accordingly, the present assisting device 26 ensures effective improvement in the quality at a precursory stage before reaching the print-quality failure. That is, it is possible to obviate the print-quality failure.

For any of the above-indicated coping measures, the assisting device 26 is configured such that information as to the coping measures is indicated, by the measure informing portion 208, on a display 216 (FIG. 1) as an indication device provided on the operation panel 214 of the assisting device 26, for the purpose of informing the operator of execution of the coping measures. Further, since the coping measures other than "solder supply" and "solder kneading" are automatically executable by the printer 10, the assisting device 26 is configured such that commands for permitting the printer 10 to execute those coping measures are transmitted by the measure transmit portion 206 to the printer 10. The printer 10 automatically executes the measures according to the commands upon reception of the commands.

<Examples 2 of Coping Measure to be Determined>

The following TABLE 2 shows examples of the coping measure determined by the measure determining portion 204 according to another linking set by the user.

TABLE 2

| Kind of Print-Quality | Coping Measure | | | |
|---|---|---|---|---|
| Deterioration/Failure | 1 | 2 | 3 | 4 |
| Area Increase | D Cleaning | W Cleaning | V Cleaning | Printing Suspension |
| Area Decrease | V Cleaning | Solder Supply | Printing Suspension | |
| Protrusion Formation | W Cleaning & In-machine Temperature −1° C. | Speed-up of Substrate Separation | Printing Suspension | |
| Thickness Decrease | V Cleaning | Reciprocating Printing | Printing Suspension | |
| Thickness Increase | Reciprocating Printing | Solder Kneading | Printing Suspension | |
| Print Shift | Offset Processing | Printing Suspension | | |
| Solder Bridge | Printing Suspension | | | |
| Solder Lack | Printing Suspension | | | |
| Excessive Thickness | Printing Suspension | | | |

D Cleaning: dry cleaning
W Cleaning: wet cleaning
V Cleaning: wet vacuum cleaning More specifically, where the phenomenon of "area increase" occurs, "dry cleaning" is initially determined as the measure for improving the print quality. Where the print quality is not improved by the measure of "dry cleaning", the measure of "wet cleaning" is determined. Where the print quality is not improved by the measure of "wet cleaning", the measure of "wet vacuum cleaning" is determined. Where the print quality is not improved by the measure of "wet vacuum cleaning", the measure of "printing suspension" is determined. To deal with "area decrease", the measure of "wet vacuum cleaning" is determined. Where the print quality is not improved by the measure of "wet vacuum cleaning", the measure of "solder supply" is determined. Where the print quality is not improved by the measure of "solder supply", the measure of "printing suspension" is determined. To deal with "protrusion formation", the measure of "lowering the temperature in the printer 10 by 1° C." is determined in addition to the measure of "wet cleaning". Where the quality is not improved by those measures, the measure of "speed-up of the substrate separation" is determined in which the separation speed at which the substrate is separated or moved away from the screen 72 upon completion of the printing is increased. Where the quality is not still improved, the measure of "printing suspension" is determined. To deal with "thickness decrease", the measure of "wet vacuum cleaning" is initially determined. Where the quality is not improved by the measure of "wet vacuum cleaning", the measure of "reciprocating printing" and the measure of "printing suspension" are determined in order. To deal with "thickness increase" and "print shift", the measures are determined in the same manner as indicated in the above TABLE 1. To deal with "solder bridge", "solder lack", and "excessive thickness", each of which is the print-quality failure, the measures are determined in the same manner as indicated in the above TABLE 1.

Also in the determination of the measures according to the TABLE 2, a plurality of remedial measures are determined for certain kinds of the print-quality deterioration. More specifically, a plurality of remedial measures are stepwise determined against the print-quality deterioration such as "area increase", "area decrease", "protrusion formation", "thickness decrease", and "thickness increase". Further, as in the determination according to the above TABLE 1, the printer 10 automatically executes the coping measures other than "solder supply" and "solder kneading".

<Setting of Printing Operation Assisting Device>

As explained above, the assisting device 26 is configured to be arbitrarily settable as to the determination of the coping measure in accordance with the kind of the print-quality deterioration or the print-quality failure, so as to enable the determination of the coping measure suited for the user. This setting is executed by the measure linking setting portion 210 on the basis of inputting by the operator into the operation panel 214. The manipulation for the setting is carried out using a graphical user interface (GUI). More specifically, the operator places suitable icons in a setting screen while viewing the setting screen indicated on the display 216.

Figure 10:
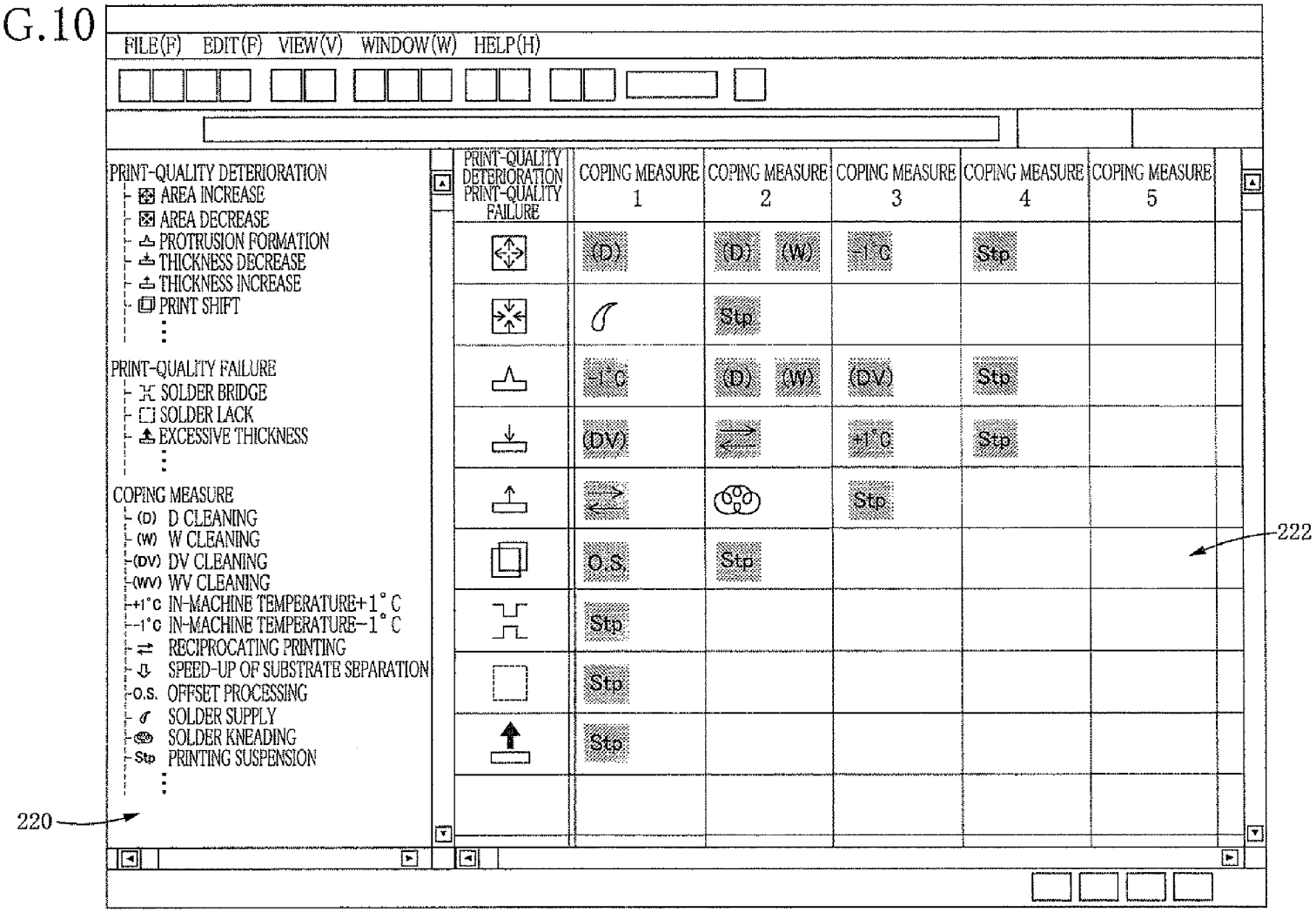
FIG. 10 is a view showing a screen displayed when linking between a print-quality deterioration/print-quality failure and a coping measure is conducted in the printing operation assisting device.

FIG. 10 shows a setting screen indicated on the display 216 for setting the inking of the coping measure. The setting screen shown in FIG. 10 is a screen in a state in which the setting for executing the determination of the coping measure according to the above TABLE 1 has been completed. The setting screen includes: an icon list area 220 in which are listed icons showing kinds of the print-quality deterioration and the print-quality failure and icons showing the coping measures; and an icon placement area 222 in which the icons are to be placed. In the icon placement area 222, a plurality of cells arranged in matrix are formed. In each of the cells in the leftmost column (generally square cells), the icons showing the kinds of the print-quality deterioration and the print-quality failure can be placed. In each of the cells in the other columns (rectangular cells in each of which the long-side dimension is twice the short-side dimension), up to two icons showing the coping measures can be placed.

The manipulation for the setting is implemented by placing the icons in the icon list area 220 into the cells of the icon placement area 222 in a drag-and-drop manner, for instance. More specifically, an arbitrary icon showing the kind of the print-quality deterioration or the print-quality failure is initially placed into an arbitrary cell into which the arbitrary icon can be placed. Other cells in the same row are cells into which are to be placed icons showing the coping measures against the print-quality deterioration or the print-quality failure indicated by the arbitrary icon. Into the other cells in the same row, icons showing arbitrary coping measures are placed. Thus, certain coping measures are linked as the coping measures against a certain kind of the print-quality deterioration or the print-quality failure.

Where an arbitrary icon showing the print-quality deterioration or the print-quality failure is placed into an arbitrary cell, the coping measure recommended for the print-quality deterioration or the print-quality failure indicated by the placed icon can be indicated with respect to the icons of the coping measures listed in the icon list area 220, by a prescribed operation. Concretely, owing to setting by the operator, a certain mark (e.g., asterisk) is attached to an icons) showing the recommended coping measure(s) or an icon(s) showing the coping measure(s) other than the recommended coping measure(s) are indicated in halftone (namely, are grayed out). Such arrangements are selectably executed and help the operator to select an appropriate coping measure(s).

The cells into each of which the icon of the coping measure is to be placed are provided in a plurality of columns. The coping measure is executed in order from the one indicated by the icon in the leftmost column. That is, as for the print-quality deterioration, where a certain kind of the print-quality deterioration occurs, the coping measure (the remedial measure) indicated by the icon placed in the leftmost column is initially executed. Where the print-quality deterioration is not remedied by the measure, the coping measures indicated by the icons placed in the next cells on the right side of the cell are sequentially executed stepwise. Where two icons are placed in one cell, the coping measures indicated by the respective two icons are executed concurrently or successively as one coping measure.

Shading on the icons placed in the cells indicates that the coping measure indicated by each shaded icon is automatically executed. In other words, where the coping measure indicated by the shaded icon is determined, the command relating to the measure is sent from the measure transmit portion 206 to the printer 10, and the printer 10 executes the coping measure based on the command. Conversely, where the coping measure indicated by a non-shaded icon is determined, there is displayed, on the display 216, information to the effect that "the coping measure should be executed", but the command is not sent to the printer 10. For instance, where the user wants to continue the printing operation, shading is not applied to the icon indicating "printing suspension". In this respect, shading is configured to be applied by a prescribed operation after the icon indicating the coping measure had been place into the cell.

Modified Embodiment

In the system described above, "solder bridge", "solder lack", and "excessive thickness" are regarded as "print-quality failure". In an instance where these phenomena occur, the coping measure of "printing suspension" is immediately determined. However, "solder bridge", "solder lack", and "excessive thickness" may be also regarded as "print-quality deterioration", and the assisting device 26 may be configured such that the measure determining portion 204 determines once or a plurality of times in steps the remedial measures, against the phenomena, such as various "cleaning", "solder supply" and "change of the in-machine temperature" and such that, where the quality is not improved by the remedial measures, "printing suspension" is determined.

The system described above is equipped with only one printer 10. A plurality of the printers 10 may be disposed in the system in series or in parallel. In this instance, each printer 10 may be configured to send identification information obtained from the ID mark of the substrate on which the printer 10 has performed the printing to the inspecting device 22 and the assisting device 26. The inspecting device 22 and the assisting device 26 may be configured to specify in which of the plurality of printers 10 the print-quality deterioration or the print-quality failure has occurred, on the basis of the ID information. The assisting device 26 may be configured to determine the coping measure for the specified printer 10 and to issue a command to that printer 10 or its operator.

What is claimed is:

1. A printing operation assisting device for assisting a printing operation performed by a solder printer configured to print a solder cream on a surface of a substrate, comprising:

a measure determining portion configured to determine a remedial measure against a deterioration of a print quality specified on the basis of print-result information obtained from an inspecting machine configured to inspect a print result of the printing operation performed by the solder printer, in accordance with a kind of the deterioration of the print quality; and a measure issuing portion configured to issue a command relating to the remedial measure determined by the measure determining portion to at least one of the solder printer and an operator of the solder printer, wherein a plurality of different remedial measures for which a priority order for execution is set are prepared against a certain deterioration of the print quality, and wherein the measure determining portion is configured to determine, against the certain deterioration of the print quality, a remedial measure from among the plurality of remedial measures according to the priority order and to redetermine another remedial measure different from the previously determined remedial measure according to the priority order where the deteriorated print quality is not improved by execution of the previously determined remedial measure.

2. The printing operation assisting device according to claim 1, wherein the solder printer is configured to execute, as the remedial measure, a plurality of mutually different cleaning operations for cleaning a lower surface of a screen, and wherein the measure determining portion is configured to determine a certain cleaning operation as one remedial measure and to redetermine, as the remedial measure, another cleaning operation different from the previously determined certain cleaning operation where the deteriorated print quality is not improved by execution of the previously determined certain cleaning operation.

3. The printing operation assisting device according to claim 1, wherein the measure determining portion is configured to determine a measure relating to suspension of the printing operation where the print quality is not improved by execution of the remedial measure, and wherein the measure issuing portion is configured to issue the measure relating to suspension of the printing operation.

4. The printing operation assisting device according to claim 1, wherein the measure determining portion is configured to determine the remedial measure on the basis of a linking between the kind of the deterioration of the print quality and the remedial measure, and wherein the printing operation assisting device further comprises a measure linking setting portion configured to set the linking on the basis of an intention of an operator of the printing operation assisting device.

5. The printing operation assisting device according to claim 4, further comprising a display, wherein the measure linking setting portion is configured to indicate, on the display, (a) an icon list area in which are listed icons relating to various kinds of the deterioration of the print quality and icons relating to a plurality of executable remedial measures and (b) an icon placement area in which arbitrary ones of the listed icons can be placed by a manipulation of the operator of the printing operation assisting device, and wherein the measure linking setting portion is configured to interrelate a certain kind of the deterioration of the print quality indicated by one icon placed in the icon placement area and the remedial measure indicated by at least one icon placed at a position in the icon placement area that corresponds to a position of the one icon, as the remedial measure against the certain kind of the deterioration of the print quality.

6. The printing operation assisting device according to claim 1, further comprising, a print-quality deterioration specifying portion configured to judge an occurrence of the deterioration of the print quality on the basis of the print-result information obtained from the inspecting machine and to specify the kind of the deterioration of the print quality.

7. The printing operation assisting device according to claim 1, wherein the solder printer is configured to execute, as the printing operation, an operation in which the solder cream on an upper surface of a screen is printed on the surface of the substrate by a squeegee through the screen with a lower surface of the screen pressed onto the substrate, and wherein the measure determining portion is configured to determine, as the remedial measure, any of cleaning of the lower surface of the screen, an adjustment of the solder cream, and a change of conditions of the printing operation.

8. The printing operation assisting device according to claim 1, wherein the plurality of different remedial measures comprises a selection from a group including: dry cleaning, wet cleaning, dry vacuum cleaning, wet vacuum cleaning, increasing a temperature in the printer, decreasing the temperature in the printer, reciprocating printing, offset processing, solder kneading, suspending printing, supplying solder, and speeding up substrate separation.

* * * * *